US009101789B2

(12) United States Patent
Schierenbeck et al.

(10) Patent No.: US 9,101,789 B2
(45) Date of Patent: Aug. 11, 2015

(54) BELT AND HARNESS ASSEMBLY

(75) Inventors: Alan W. Schierenbeck, Dayton, OH (US); Linda B. Shingleton, New Carlisle, OH (US)

(73) Assignee: Honeywell International Inc., Morristown, NJ (US)

( * ) Notice: Subject to any disclaimer, the term of this patent is extended or adjusted under 35 U.S.C. 154(b) by 605 days.

(21) Appl. No.: 12/915,339

(22) Filed: Oct. 29, 2010

(65) Prior Publication Data

US 2011/0101061 A1 May 5, 2011

Related U.S. Application Data

(60) Provisional application No. 61/257,647, filed on Nov. 3, 2009.

(51) Int. Cl.
*A62B 18/02* (2006.01)
*A62B 35/00* (2006.01)

(52) U.S. Cl.
CPC ..... *A62B 35/0031* (2013.01); *A62B 35/0012* (2013.01); *A62B 35/0025* (2013.01)

(58) Field of Classification Search
CPC ..... A62B 35/0068; A62B 35/0006
USPC ..... 182/6, 7; 2/311
See application file for complete search history.

(56) References Cited

U.S. PATENT DOCUMENTS 946,974 A * 1/1910 molloy ..... 24/194
2,149,803 A * 3/1939 Wight ..... 224/259
2,819,830 A * 1/1958 Murray ..... 224/578
2,938,254 A * 5/1960 Gaylord ..... 24/171
3,212,690 A * 10/1965 Green ..... 224/576
4,121,822 A * 10/1978 DiSabatino et al. ..... 482/88
4,197,816 A * 4/1980 Lusch ..... 182/3
4,247,117 A * 1/1981 Reichert ..... 473/424
5,010,850 A * 4/1991 Sailer ..... 297/129
5,036,548 A * 8/1991 Grilliot et al. ..... 2/81

(Continued)

FOREIGN PATENT DOCUMENTS

CH 695238 A5 * 2/2006
GB 2406078 A * 3/2005 ..... B60R 22/12

OTHER PUBLICATIONS

Modern Language Association (MLA): "article." Dictionary.com Unabridged. Random House, Inc. May 3, 2013. <Dictionary.comhttp://dictionary.reference.com/browse/article>.*

(Continued)

*Primary Examiner* — Katherine Mitchell
*Assistant Examiner* — Candace L Bradford
(74) *Attorney, Agent, or Firm* — Wood, Phillips, Katz, Clark & Mortimer

(57) ABSTRACT

An escape/ladder belt and harness assembly having an improved attachment arrangement and adjustment capabilities. The assembly features a waist belt having a coupling and fastener each featuring at least two slots separated by at least one bar. The fastener being connectable to the coupling to enable the waist belt to fasten around a user. The waist belt being removeably attached to an article worn by the user through a plurality of tabs. At least some of the tabs fastening the coupling and fastener to the article. The waist belt extending around the user and though a tension adjustment buckle so as to allow for waist tension to be set by pulling the free end of the waist belt in an intuitive forward motion that provides for improved tightening around the user.

21 Claims, 10 Drawing Sheets

(56) References Cited

U.S. PATENT DOCUMENTS

| | | | | |
|---|---|---|---|---|
| 5,067,585 | A * | 11/1991 | Bell | 182/7 |
| 5,323,942 | A * | 6/1994 | Dahan | 224/639 |
| 5,566,397 | A * | 10/1996 | Scott | 2/338 |
| 5,692,237 | A * | 12/1997 | Bennett | 2/93 |
| 6,189,651 | B1 * | 2/2001 | Sadeck | 182/6 |
| 6,192,835 | B1 * | 2/2001 | Calhoun et al. | 119/792 |
| 6,389,605 | B2 * | 5/2002 | Srivastava | 2/312 |
| 6,490,733 | B1 * | 12/2002 | Casaubon | 2/81 |
| 6,698,544 | B2 * | 3/2004 | Kurtgis | 182/3 |
| 6,732,834 | B2 * | 5/2004 | Colorado | 182/6 |
| 6,932,027 | B1 * | 8/2005 | Whitney | 119/770 |
| 7,240,638 | B2 * | 7/2007 | Burton | 119/770 |
| 8,281,894 | B2 * | 10/2012 | Mordecai et al. | 182/3 |
| 2001/0047904 | A1 * | 12/2001 | Antonio | 182/3 |
| 2006/0011415 | A1 * | 1/2006 | Fischer et al. | 182/7 |
| 2006/0169534 | A1 * | 8/2006 | Green | 182/7 |
| 2008/0230313 | A1 * | 9/2008 | Botti | 182/70 |
| 2008/0245610 | A1 * | 10/2008 | Lee | 182/5 |
| 2011/0179553 | A1 * | 7/2011 | Hazlett | 2/311 |
| 2011/0284324 | A1 * | 11/2011 | Schubert et al. | 182/70 |
| 2011/0290586 | A1 * | 12/2011 | Goldmann et al. | 182/3 |
| 2011/0290845 | A1 * | 12/2011 | Jackson | 224/661 |
| 2012/0292129 | A1 * | 11/2012 | Seman | 182/9 |
| 2013/0175117 | A1 * | 7/2013 | Schierenbeck | 182/3 |
| 2014/0130230 | A1 * | 5/2014 | Blinka et al. | 2/82 |

OTHER PUBLICATIONS

Modern Language Association (MLA): "garment." Dictionary.com Unabridged. Random House, Inc. May 3, 2013. <Dictionary.comhttp://dictionary.reference.com/browse/garment>.*

* cited by examiner

BELT AND HARNESS ASSEMBLY

CROSS REFERENCE TO RELATED APPLICATION

This application claims the benefit of U.S. Provisional Application Ser. No. 61/257,647 filed Nov. 3, 2009 entitled "Harness/Escape Ladder Belt" The entirety of this application is incorporated by reference as if fully set forth herein.

FIELD OF THE INVENTION

Embodiments of the subject invention are directed to a belt and harness assembly, and more particularly to an escape/ladder belt and harness having an improved attachment arrangement and adjustment capabilities.

BACKGROUND OF THE INVENTION

It is generally understood that firefighters, construction workers and rescue personnel can face some of the most extreme and demanding conditions in performing their duties. In carrying out their work, such personnel will commonly need to be able to access, work on, or escape from areas that are elevated or recessed, or otherwise inaccessible without special equipment. In order to safely access and carry out work in such locations, firefighters, construction workers and rescue personnel commonly rely on a personal safety belt or harness in order to fasten themselves to a ladder or rescue line. Indeed, personal belts and harnesses play such a critical role with respect to safety and operation that they are commonly considered to be standard operating equipment for fire and rescue personnel as well as for certain construction and industrial applications. Such equipment is commonly relied upon to bear the weight of the user and to carry and support gear or tools the user requires for the particular operation.

Typically, rescue personnel in an emergency response situation, will need to get into their equipment quickly. Known belts and harnesses can pose an obstacle in this respect as they are generally an additional piece of equipment that the user has to put on, fasten and adjust. This can sometimes be a time consuming and chaotic process causing the user undue stress and anxiety. In addition, depending on how they were left after their prior use, known belts and harnesses can commonly be twisted, knotted or otherwise in a disordered condition that the user will have to sort out before being able to put on. The additional time needed to sort out a disordered belt or harness can sometimes cost rescue personnel valuable minutes that are critical in responding the particular emergency condition.

In addition, known belts and harnesses are intended to be secured entirely over the user's outer clothing and thus have been known to twist or ride up on the user when the assembly is subjected to a load forces. Such unintended movement can interfere with the user's operations or could cause the user unintended injury or irritation.

Additionally, known belts and harnesses can be difficult to properly adjust by requiring the user to pull the loose end of a belt or strap in a backward or downward direction in which the user does not have sufficient leverage. In some instances, this can cause the belt or harness to not be sufficiently fastened around the user and can pose an extremely dangerous safety condition that could result in the user slipping out of the belt or harness during a particular operation. Maintaining proper tension of the belts and straps is especially important in the event of a head-first escape or bail out. Under such circumstances, belts and harnesses that require the user to reach back or down to tighten a particular strap or belt can become loose.

Accordingly, there is a need in the art for an easy to use escape/ladder belt and harness assembly that is a user can put on and out of quickly, and that has secure fastening capabilities that will maintain tension in any condition.

DETAILED DESCRIPTION

Figure 1:
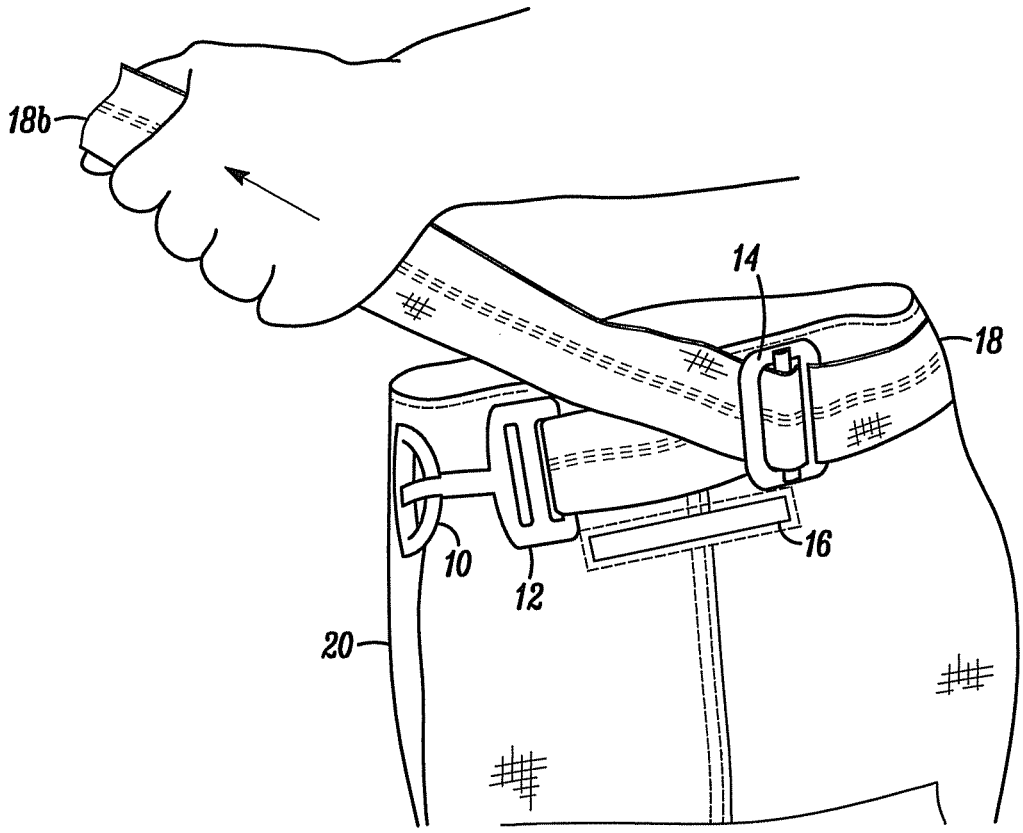
FIG. 1 is a side elevational view of the belt and harness assembly.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description") relates to a requirement of the United States Patent Office, and should not be found to limit the subject matter disclosed herein.

In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

Figure 2:
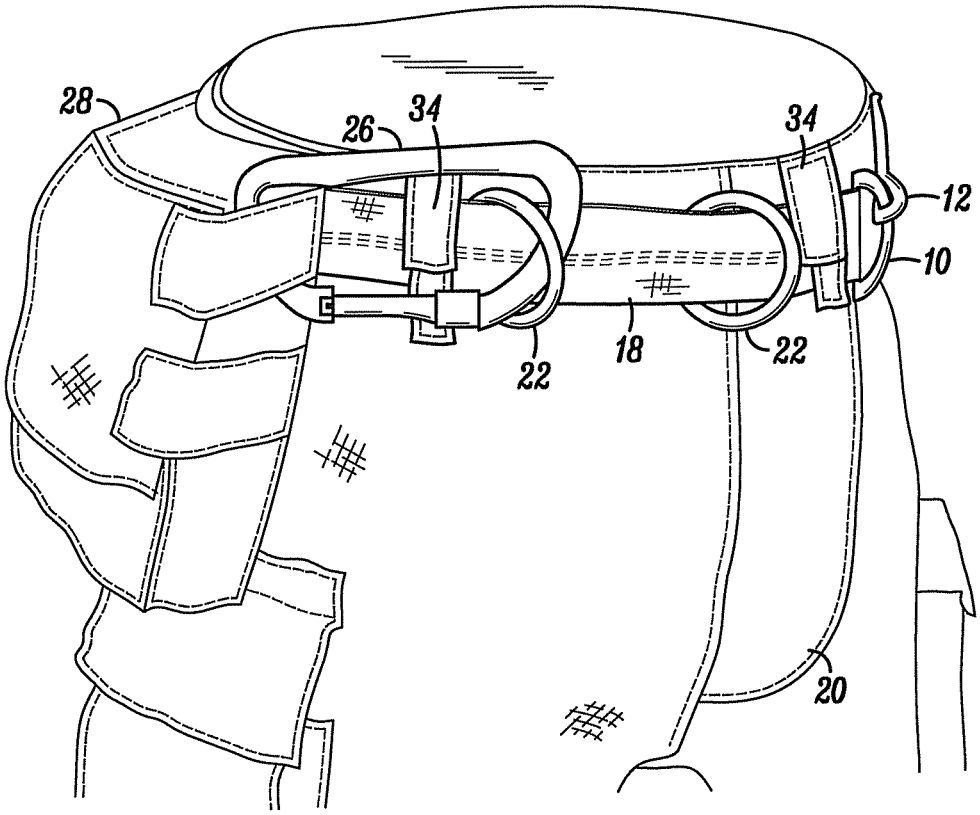
FIG. 2 is a perspective view of the belt and harness assembly fastened around a user's waist area.

Referring now to the figures, and specifically to FIGS. 1 and 2, there is shown an escape/ladder belt and harness assembly 1 affixed around the waist area of a person. As shown, the belt and harness assembly 1 can feature a waist belt 18 suitable for being worn around the waist of a user. The waist belt 18 has a first end 18*a* affixed around a slotted coupling 10 and a second free end 18*b* suitable for being manipulated by the user in order to be tightened around the user's waist. The waist belt 18 can be comprised of a flexible, durable and high strength woven fabric webbing material, such as for example nylon, polyester, polypropylene, Dyneema® or Kevlar® material. In addition, persons of ordinary skill in the art will understand that the waist belt can have varying sizes, widths or lengths without varying from the novel scope of the subject invention.

The slotted coupling 10 is affixed to the belt and harness assembly 1 proximate the first end 18*a* of the waist belt 18. The coupling 10 can be comprised of a rigid high strength metal alloy, or any other durable, high-strength material. The coupling 10 features at least two slots separated by at least one divider bar. The two slots and divider bar allow multiple articles, fasteners and tethers to be fastened to the coupling from different directions without interfering with one another. As shown in the figures, and particularly FIGS. 7-9, the coupling 10 can be a slotted D-ring with additional slots as needed. However, persons of ordinary skill in art, will understand that the coupling 10 can be comprised of other high strength hardware having alternative shapes and sizes without departing from the novel scope of the subject invention. The coupling 10 can be fixedly or removably attached to the waist belt 18 proximate the first end 18*a*. According to various embodiments, the waist belt 18 can extend through one of the slots of the coupling 10 and be folded back onto itself. The first end 18*a* of the waist belt 18 can be provided with cooperative attachment or fastening means, such as hook and eye fasteners, in order to permit fastening the waist belt 18 onto itself.

The escape/ladder belt and harness 1 additionally features a fastener 12 along the length of the waist belt 18 between the first and second ends 18*a*, 18*b*. The fastener 12 is capable of being secured to the coupling 10 in order to enable the waist belt 18 to fasten around a user. When the fastener 12 is secured to the coupling 10, the waist belt 18 extends about the user's waist such that the inside surface of the waist belt 18 is disposable toward the user. The fastener 12 features at least two slots separated by at least one divider bar. The two slots and divider bar enables the fastener 12 to be coupled to both the waist belt 18 and an article 20 worn by the user, such as for example a garment. As described more fully below, the fastener 12 is secured to the article 20 by having a mounting tab 48 secured around the divider bar. As shown in the figures, and particularly FIGS. 7-9, the fastener 12 can be a "parachute" style snap hook having an additional slots as required. However, persons of ordinary skill in art, will understand that alternative types of fasteners can be used without departing from the novel scope of the subject invention.

As shown in FIG. 1, the waist belt 18 passes through a waist tension adjustment buckle 14 such that the second end 18*b* of the waist belt 18 extends from the buckle 14 in a forward direction towards the front side of the user. This arrangement provides for improved adjustment capabilities by allowing the user to pull the second end 18*b* of the waist belt 18 in an intuitive forward motion that allows better leverage for a tight fit of the belt and pant waist above the wearer's hip bones. This arrangement is unlike prior art belts which can be extremely difficult to tighten because they require the user to "pull" the free end of the belt towards the rear in an un-natural motion. In addition, by having the free end 18*b* of the waist belt 18 extending towards the front of the user, it is also easier for the user to locate and grasp in the event that further tightening is needed. The arrangement is further beneficial because it is more effective in retaining the user in the event of a head-first escape or bail out because the user's own weight is displaced in such a manner so as to increase the locking action of the buckle 14.

FIG. 2 shows additional features of the subject invention according to various embodiments. As shown, the belt and harness 1 can include one or more attachment rings 22 and/or an escape bag 28 located along the waist belt 18. The attachment rings 22 can be suitable for serving as additional attachment points for tools, connectors, or tethers. In particular, an attachment ring 22 can serve as a connection point for a tether that enables the assembly to be used as a certified ladder belt. The attachment rings 22 can be comprised of a rigid high strength metal alloy, or any other durable high strength material. As shown in the figures, the waist belt 18 extends though an attachment ring 22 such that the ring 22 can slide along the belt as desired by the user. The escape bag 28 can have a lightweight and compact design that offers storage for equipment, such as carabiners, or rope, and can be located in a position along the belt so as to allow easy access for rapid deployment of any contents. The escape bag 28 can be fastened to the waist belt 18 by one or more connecting devices 26 fastened to one or more of the attachment rings 22.

Figure 3A:
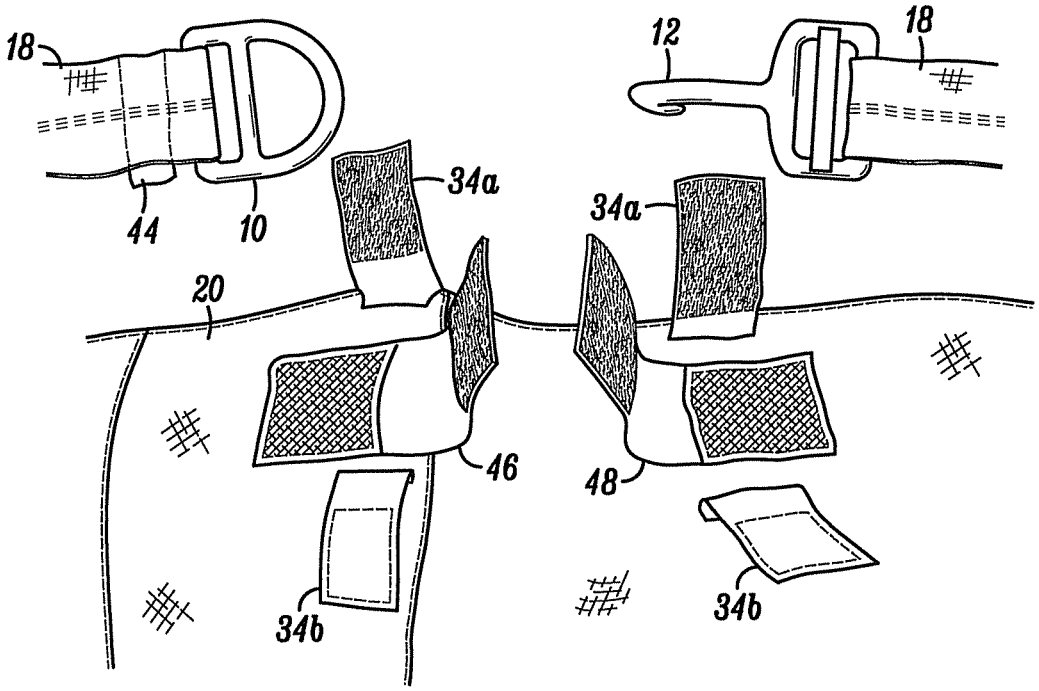
FIG. 3A is a first perspective detail view of attachment means of the belt and harness assembly.
Figure 3B:
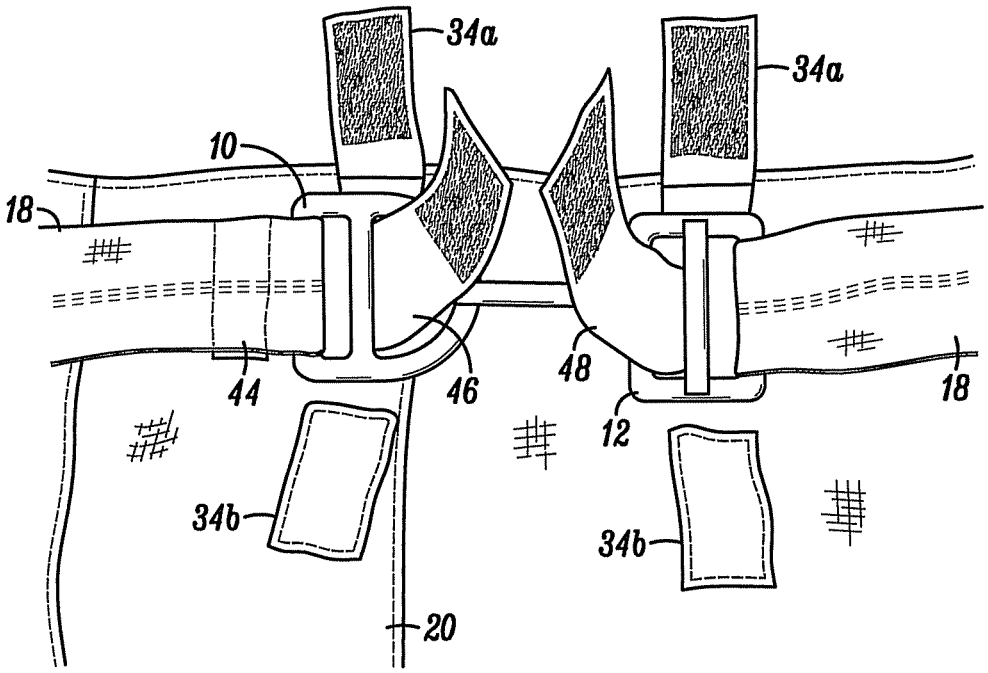
FIG. 3B is a first detail view in elevation of attachment means of the belt and harness assembly.
Figure 3C:
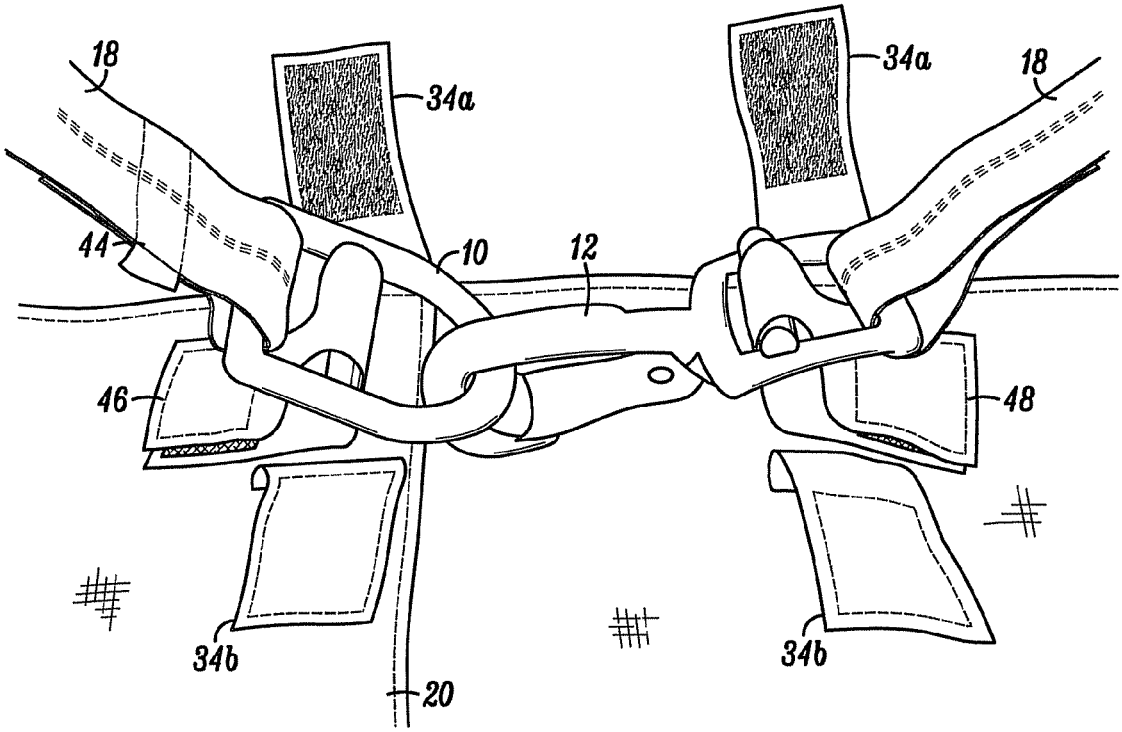
FIG. 3C is second perspective detail view of attachment means of the belt and harness assembly.
Figure 3D:
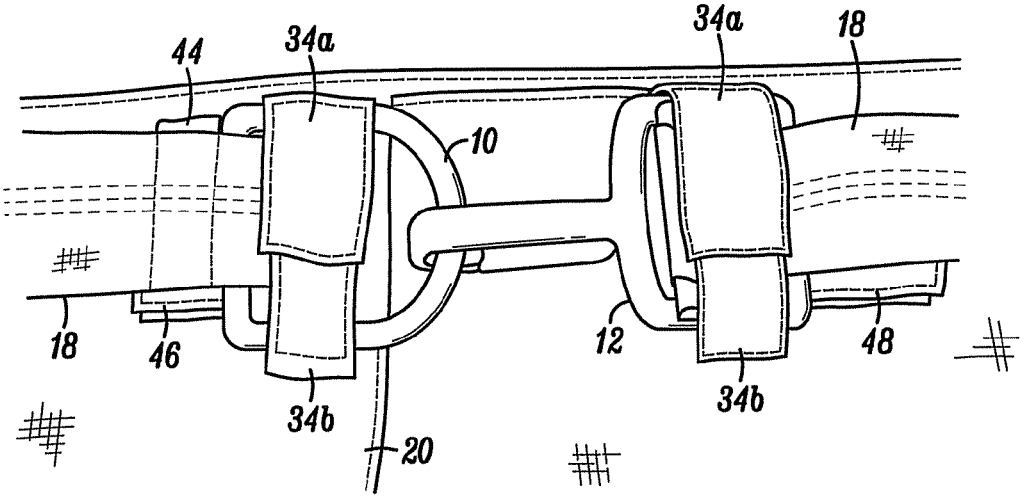
FIG. 3D is a second detail view in elevation of attachment means of the belt and harness assembly.

FIGS. 3A-3D illustrate additional embodiments that show an arrangement for attaching the belt and harness assembly 1 to an article or garment 20 worn by the user, such as for example, a pair of pants, shorts, overalls, coveralls, a vest, shirt, jacket or coat. As shown in these figures, the article 20 features first and second opposite mounting tabs 46, 48. The first mounting tab 46 is suitable for being removeably connected around the coupling 10, and the second opposite mounting tab 48 is suitable for being removeably connected around the fastener. According to various embodiments, the mounting tabs 46, 48 are located at the front of the garment 20, around the waist/fly closure. The mounting tabs 46, 48 can be made from fabric and hook & loop style fastener tape. As shown in FIGS. 3B-3C, the first mounting tab 46 can loop around a divider bar of the coupling 10 and fold back upon itself where it can be secured to itself or an attachment tab 44 on the waist belt 18. Similarly, the second mounting tab 48 can loop around a divider bar of the fastener 12 and fold back upon itself where it can be secured to itself or an attachment tab 44 on the waist belt 18. As an alternative, these mounting tabs 46, 48 can be threaded through retaining tabs 44 located on the waist belt 11 in order to secure the coupling 10 and fastener to the article 10.

This attachment system offers unique and superior advantages in the areas of emergency response. Specifically, when the garment is stowed, the belt and harness assembly 1 is affixed to the garment and is readily accessible. During rapid donning and while adjusting the waist belt tension, the attachment arrangement enables the belt and harness to be adjusted faster, surer, safer and easier. In addition, the waist belt 18 will not rotate within the belt loops/tabs so secure tension is easily attained, making any emergency egress a safer undertaking.

FIGS. 3A-3D additionally show the article 20 having a retaining tabs 34 having a first part 34*a* and a second part 34*b*. As shown, retaining tabs 34 are capable of extending over the coupling 10 or the fastener 12 in a direction substantially perpendicular to the waist belt so as to secure the coupling 10 or fastener 12 against the user's garment 20. The retaining tab 34 can have a fastener that secures the first part 34*a* of the tab 34 to the second part 34*b*. The fastener can be hook and loop style fastener tape, or any functional alternative.

As shown in FIGS. 2 and 4-6, the article 20 can additionally feature additional retaining tabs 34 to further secure the waist belt 18 about the waist of the user. The additional retaining tabs 18 can be capable of extending over the outside surface of the waist belt 18 in a direction substantially perpendicular to the waist belt 18.

Figure 4:
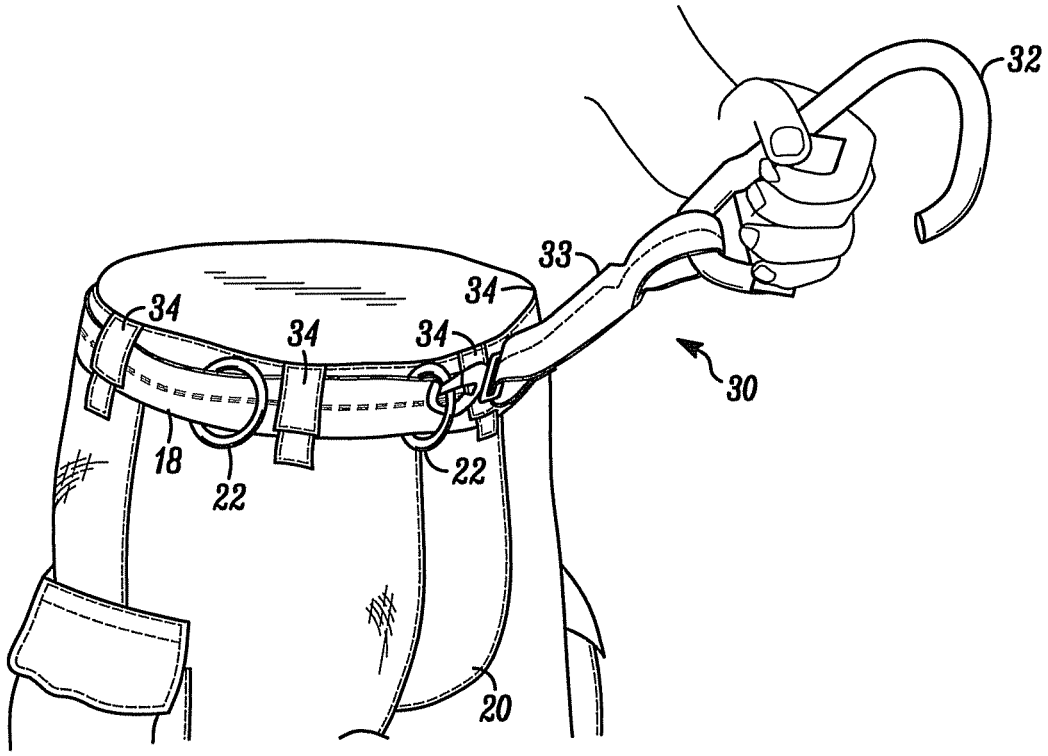
FIG. 4 is a perspective view of the belt and harness assembly having a tether attachment.
Figure 4A:
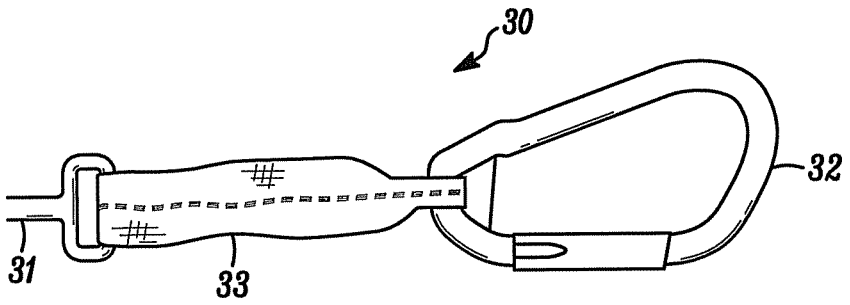
FIG. 4A is a detail view of the tether attachment shown in FIG. 4.

FIGS. 4 and 4*a* show the belt and harness assembly 1 including a removably attached tether assembly 30. According to various embodiments, the tether assembly 30 can be removably affixed to an attachment ring 22 along the waist belt 18. As shown in the figures, the tether assembly 30 can feature a connector device 31, such as for example a snap hook. The snap hook is connected to a connector 32 by a means of a high-strength strap or cable 33. The connector 32 can be any kind of commercially available fastener or anchoring device suitable for affixing the tether assembly 30 to other equipment or lines. The tether assembly 30 can be stowed in the user's pocket or escape bag 28, or left connected to the attachment ring 22 and folded back against the user's pant below the waist, where it can be stowed using additional webbing material and/or hook and loop or snap type fastener devices.

Figure 5:
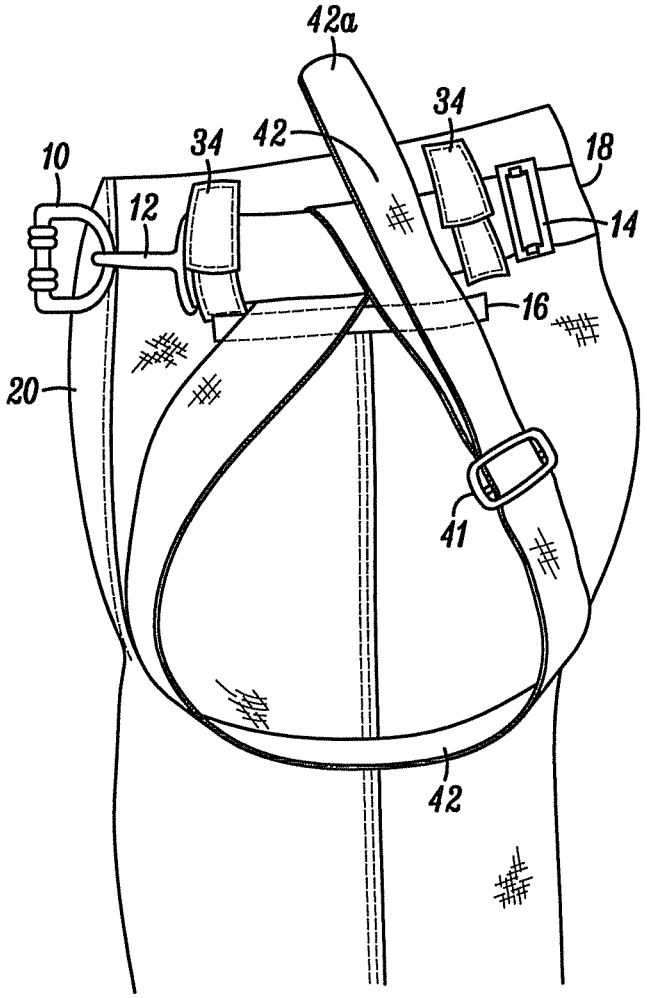
FIG. 5 is a side elevational view of the belt and harness assembly having leg straps.
Figure 6:
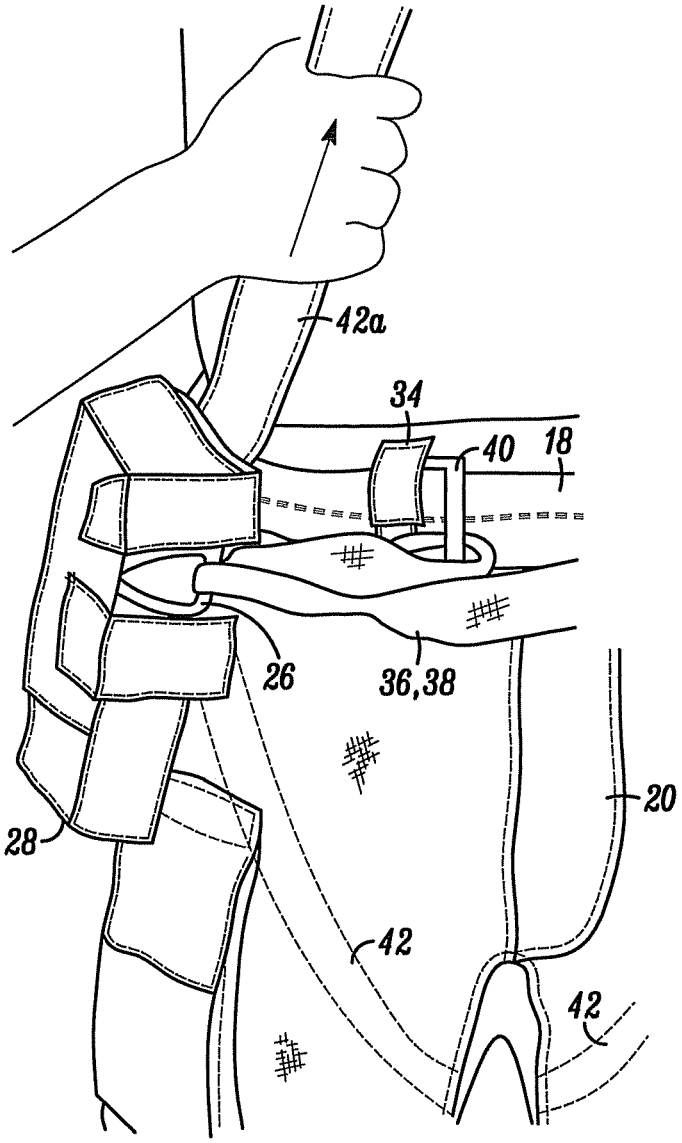
FIG. 6 is a partial front elevational view of the belt and harness assembly having an escape bag mounted thereto.
Figure 7:
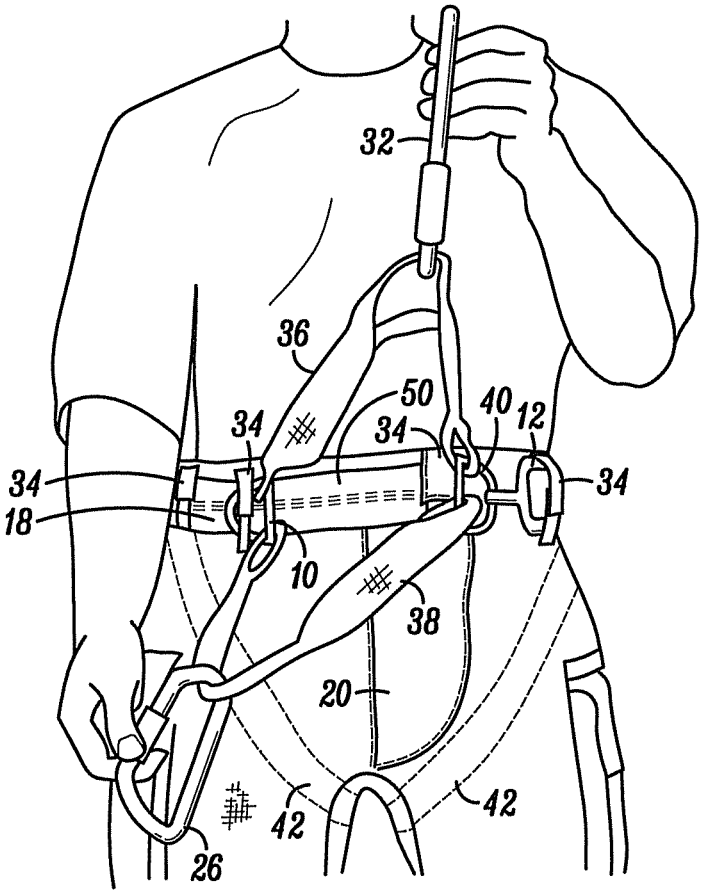
FIG. 7 is a front elevational view of the belt and harness assembly having A-frame and V-frame attachments.

FIGS. 5-7 show another embodiment of the belt and harness assembly 1. As shown in these figures, the belt and harness assembly 1 features looping leg straps 42 affixed to the waist belt 18. The leg straps 42 can be constructed of a continuous looping strip of woven fabric webbing material, such as for example nylon, polyester, polypropylene, Dyneema®, or Kevlar®. The leg straps 42 can be of varying sizes or widths without departing from the novel scope of the invention. Each leg strap 42 extends through a leg tension adjustment buckle 41 that enables the user to tighten each leg strap 42 around the upper portion of a leg. The leg straps 42 can be removably or permanently secured to the waist belt 18 and further wrap around the waist belt 18 to provide extra support in the event that a rupture or tear occurs at the point of connection between the leg strap 42 and waist belt 18. The leg straps 42 can be sewn to the waist belt 18 or removably secured together by a fastening means, such as for example hook and loop fasteners, or other types of attachment means.

The leg straps 42 can be worn outside or underneath the garment 20. As shown in FIG. 5, the garment or article 20 can be provided with an aperture 16 that allows the leg straps 42 to extend from the waist belt 18 underneath the garment 20 and back out again to wrap around the belt 18. The ability to conceal the leg straps 42 underneath the garment 20, generally protects them from abrasion or snagging that may occur during use. As shown in FIG. 5, the leg strap 42 passes through the leg tension adjustment buckle 41 such that the free end 42*a* extends in an upward direction away from the buckle 41. The free end 42*a* of the leg strap 42 can continue to extend out through the aperture 16 in order to enable the user to tighten the leg straps outside the garment 20 without having to remove the garment. This arrangement provides for easier and improved tightening capability by enabling a user to tighten the leg strap 42 by pulling the free end in upward direction. The aperture 16 can have a horizontally slotted shape, an angled slotted shape, or can have an alternative shape or configuration in order to accommodate the looping leg strap 42. In addition, the aperture can be located in various positions on the garment, such as for example inside a pocket or covered by a flap.

FIG. 6 shows the belt and harness assembly 1 additionally featuring an escape bag system 28 secured in place on the waist belt 18 having leg straps 42. As shown in this figure, the configuration of the belt and harness assembly 1 enables the free end 42*a* of the leg strap 42 to be grasped by the user and adjusted for tension around the legs and buttocks. The figure also shows the leg straps 42 being worn internally and underneath the user's garment 20, which leaves more room for the user to be able to access optional pocketing on the exterior of the garment 20. FIG. 6 additionally shows the belt and harness assembly 1 with only an inverted V-Frame/A-Frame 36, 38 pre-connected to the escape bag system 28 by means of a connector device 26. Attachment of the V-Frame/A-Frame is described below in connection with FIG. 7.

FIG. 7 shows an additional embodiment for the belt and harness assembly 1 that includes an additional extension belt 50 and secondary coupling 40 for supporting an A-Frame 36 or V-Frame 38 tether, or both, that can be used for escape, ladder or rescue work. As shown, the extension belt 50 features a first end and a second end, and the secondary coupling 40 can be a slotted coupling with a divider bar. The extension belt 50 can be comprised of the same material as the waist belt 18 or an alternative high strength webbing. The secondary coupling 40 can be a slotted D-Ring, a "Double D-Ring," or an alternative coupling having multiple slots and at least one divider bar. In securing the extension belt to the harness assembly, the first end of the extension belt 50 can be affixed to the divider bar of the coupling 10 and the second end of the extension belt 50 can be affixed to the divider bar of the secondary coupling 40. In this arrangement, the waist belt 18 is secured to the coupling 10 by looping through the coupling's first slot. In this arrangement, fastener 12 is affixed to the secondary coupling by being fastened through the secondary coupling's first slot. In this position, an A-Frame or V-Frame tether 36, 38 can additionally be provided. The tether 36, 38 can have a first end affixed through a second slot of the coupling 10 and a second end affixed through a second slot of the secondary coupling 40. The tether 38, 40 can additionally feature one or more connector devices 26, 32 affixed between the first and second ends of the tether 36, 38. The connector device can be pre-connected to an escape bag system 28 by means of a certified and commercially available connector device 26 or by the addition of an additional sliding attachment connectors to the "A" or "V" frame itself 36, 38.

The present disclosure includes that which is contained in the appended claims, as well as that of the forgoing description. Although, this invention has been described in its preferred form with a certain degree of particularity, it is understood that the present disclosure of the preferred form has been made only by way of example, and that numerous changes in the details of the elements, compositions and the combination of individual ingredients may be resorted to without departing from the novel spirit or scope of the invention.

What is claimed is:

1. A belt and harness assembly comprising:

a waist belt having a first end and a second end, and an inside and outside surface;

a coupling affixed proximate to the first end of the waist belt, the coupling having at least two slots separated by at least one divider bar;

a waist tension adjustment buckle along the waist belt, the waist belt extending through the waste tension adjustment buckle;

a fastener affixed between the first and second ends of the waist belt, the fastener connected to the coupling, the fastener having at least two slots separated by at least one divider bar; and an article having first and second mounting tabs affixed to a surface of the article, article and extending parallel to the waist belt, the first mounting tab connected around the at least one divider bar of the coupling, the second mounting tab connected around the at least one divider bar of the fastener, the first mounting tab affixing the coupling to the article, the second mounting tab affixing the fastener to the article.

2. The belt and harness assembly of claim 1, further comprising at least one leg strap affixed to and wrapping around the waist belt, the at least one leg strap extending from the waist belt around a leg of the user and through a leg tension adjustment buckle, the at least one leg strap having a free end that extends away from the leg tension adjustment buckle in an upward direction towards the waist belt.

3. The belt and harness assembly of claim 1, further comprising at least one attachment ring upon the waist belt, the waist belt extending through the at least one attachment ring, the at least one attachment ring slideable along the waist belt.

4. The belt and harness assembly of claim 3, further comprising a tether assembly affixed to the at least one attachment ring, the tether assembly having a connector device, a fastener suitable for affixing the tether assembly to the at least one attachment ring and a strap connecting the at least one attachment ring to the fastener.

5. The belt and harness assembly of claim 1 wherein the article further comprises a coupling retaining tab having a first part and a second part, the coupling retaining tab extending over the coupling in a direction substantially perpendicular to the waist belt, the coupling retaining tab having a fastener securing the first part of the coupling retaining tab to the second part of the coupling retaining tab.

6. The a belt and harness assembly of claim 1 wherein the article further comprises a fastener retaining tab having a first part and a second part, the fastener retaining tab extending over the fastener in a direction substantially perpendicular to the waist belt, the fastener retaining tab having a fastener securing the first part of the fastener retaining tab to the second part of the fastener retaining tab.

7. The belt and harness assembly of claim 1 wherein the article further comprises at least one supplemental retaining tab having a first part and second part, the at least one supplemental retaining tab extending over the outside surface of the waist belt in a direction substantially perpendicular to the waist belt, the at least one supplemental retaining tab having a fastener securing the first part of the supplemental retaining tab to the second part of the supplemental retaining tab.

8. The belt and harness assembly of claim 1 wherein the article is a garment worn by the user.

9. The belt and harness assembly of claim 8 wherein the garment further comprises at least one aperture, the at least one leg strap extending from the waist belt through the aperture and underneath the article, the at least one leg strap looping around the user's leg underneath the article and passing through the leg tension adjustment buckle, the free end of the at least one leg strap extending outside the article through the at least one aperture.

10. The belt and harness assembly of claim 1 further comprising:

an extension belt having a first end and a second end, the first end of the extension belt secured about the divider bar of a first coupling, the waist belt secured to the first coupling by looping through a first slot of the first coupling;

a secondary coupling having at least two slots separated by a divider bar, the second end of the extension belt secured about the divider bar of the secondary coupling, the fastener being secured through a first slot of the secondary coupling;

at least one tether having a first end and a second end, the first end of the tether extending through a second slot of the first coupling, the second end of the tether extending through a second slot of the secondary coupling;

a connector device affixed to the tether between the tether's first and second ends.

11. The belt and harness assembly of claim 10 wherein at least one tether is an A-Frame tether.

12. The belt and harness assembly of claim 10 wherein at least one tether is a V-Frame tether.

13. A belt and harness assembly comprising:

a waist belt having a first end and a second end, and an inside and outside surface;

a coupling affixed proximate the first end of the waist belt, the coupling having at least two slots separated by at least one divider bar, the first end of the waist belt looping through a first slot of the coupling, the first end of the waist belt secured to the inside surface of the waist belt;

a waist tension adjustment buckle along the waist belt, the waist belt extending through the waste tension adjustment buckle, a free end of the waist belt extending away from the waist tension adjustment buckle in a forward direction;

a fastener affixed between the first and second ends of the waist belt, the fastener connected to the coupling, the fastener having at least two slots separated by at least one divider bar;

at least one leg strap affixed to and wrapping around the waist belt, the at least one leg strap extending from the waist belt around a leg of the user and through a leg tension adjustment buckle, the at least one leg strap having a free end that extends away from the leg tension adjustment buckle in an upward direction towards the waist belt; and a garment secured to the waist belt, the garment having first and second mounting tabs, tab extending parallel to the waist belt, the first mounting tab connected around the at least one divider bar of the coupling, the second mounting tab connected around the at least one divider bar of the fastener, the first mounting tab affixing the coupling to the garment, the second mounting tab affixing the fastener to the garment.

14. The belt and harness assembly of claim 13 wherein the garment has at least one aperture, the at least one leg strap extending from the waist belt outside the garment through the aperture and underneath the garment, the at least one leg strap looping around the user's leg underneath the article and passing through the leg tension adjustment buckle, the free end of the at least one leg strap extending outside the article through the at least one aperture.

15. The belt and harness assembly of claim 13, further comprising at least one attachment ring upon the waist belt, the waist belt extending through the at least one attachment ring, the at least one attachment ring slideable along the waist belt.

16. The belt and harness assembly of claim 13 wherein the garment further comprises a coupling retaining tab having a first part and a second part, the coupling retaining tab extending over the coupling in a direction substantially perpendicular to the waist belt, the coupling retaining tab having a fastener securing the first part of the coupling retaining tab to the second part of the coupling retaining tab.

17. The a belt and harness assembly of claim 13 wherein the garment further comprises a fastener retaining tab having a first part and a second part, the fastener retaining tab extending over the fastener in a direction substantially perpendicular to the waist belt, the fastener retaining tab having a fastener securing the first part of the fastener retaining tab to the second part of the fastener retaining tab.

18. The belt and harness assembly of claim 13 wherein the garment further comprises at least one supplemental retaining tab having a first part and second part, the at least one supplemental retaining tab extending over the outside surface of the waist belt in a direction substantially perpendicular to the waist belt, the at least one supplemental retaining tab having a fastener securing the first part of the supplemental retaining tab to the second part of the supplemental retaining tab.

19. The belt and harness assembly of claim 13 further comprising:

an extension belt having a first end and a second end, the first end of the extension belt secured about the divider bar of the coupling, the waist belt secured to the coupling by looping through a first slot of the coupling;

a secondary coupling, the secondary coupling having at least two slots separated by a divider bar, the second end of the extension belt secured about the divider bar of the secondary coupling, the fastener being secured through a first slot of the secondary coupling;

at least one tether having a first end and a second end, the first end of the tether extending through a second slot of the coupling, the second end of the tether extending through a second slot of the secondary coupling; and a connector device affixed to the tether between the tether's first and second ends.

20. The belt and harness assembly of claim 19 wherein the at least one tether is an A-Frame tether.

21. The belt and harness assembly of claim 19 wherein the at least one tether is a V-Frame tether.

* * * * *